US010570630B2

(12) United States Patent
Shaw

(10) Patent No.: US 10,570,630 B2
(45) Date of Patent: Feb. 25, 2020

(54) SUSPENDED SCAFFOLDING STRUCTURE AND CONNECTOR THEREFOR

(71) Applicant: Nicholas Mark Shaw, Vancouver (CA)

(72) Inventor: Nicholas Mark Shaw, Vancouver (CA)

( * ) Notice: Subject to any disclaimer, the term of this patent is extended or adjusted under 35 U.S.C. 154(b) by 865 days.

(21) Appl. No.: 14/890,329

(22) PCT Filed: May 14, 2014

(86) PCT No.: PCT/CA2014/050451
§ 371 (c)(1),
(2) Date: Nov. 10, 2015

(87) PCT Pub. No.: WO2014/183215
PCT Pub. Date: Nov. 20, 2014

(65) Prior Publication Data

US 2016/0115697 A1 Apr. 28, 2016

Related U.S. Application Data

(60) Provisional application No. 61/823,290, filed on May 14, 2013.

(51) Int. Cl.
*E04G 5/16* (2006.01)
*E04G 3/22* (2006.01)
(Continued)

(52) U.S. Cl.
CPC ..... *E04G 5/165* (2013.01); *E01D 19/106* (2013.01); *E04G 3/22* (2013.01); *E04G 5/16* (2013.01); *E04G 7/303* (2013.01); *E04G 7/304* (2013.01)

(58) Field of Classification Search
CPC ..... E04G 5/16; E04G 5/165; E04G 7/303; E04G 7/304; E04G 3/22; E01D 19/106
See application file for complete search history.

(56) References Cited

U.S. PATENT DOCUMENTS 2,882,099 A * 4/1959 Symons ..... E04G 1/14 52/645
3,752,262 A * 8/1973 Helms ..... E04G 5/14 182/113

(Continued)

FOREIGN PATENT DOCUMENTS

CA 2740549 A1 * 11/2012 ..... E04G 1/14

*Primary Examiner* — Catherine A Kelly
*Assistant Examiner* — Candace L Bradford
(74) *Attorney, Agent, or Firm* — Oyen Wiggs Green & Mutala LLP

(57) ABSTRACT

A suspended scaffolding connector includes a central spine comprising an anchor connector at a top end thereof, a bottom lug at a bottom end thereof, and a top lug situated between the anchor connector and bottom lug. The connector further includes at least one top truss connector attached to the top lug and at least one bottom truss connector attached to the bottom lug, where the top and bottom truss connectors are configured and spaced for structural connection to top and bottom connectors of a scaffolding truss. The connector also includes top and bottom truss ledger connectors attached to the spine and situated between the top and bottom lugs and adapted for connection to a scaffolding ledger, and the anchor connector is adapted for connection to a suspension anchor and to support the scaffolding truss through the top and bottom truss connectors.

24 Claims, 11 Drawing Sheets

(51) Int. Cl.
*E01D 19/10* (2006.01)
*E04G 7/30* (2006.01)

(56) References Cited

U.S. PATENT DOCUMENTS 4,234,055 A * 11/1980 Beeche ..... E04G 3/34
182/118
5,214,899 A * 6/1993 Beeche ..... E04B 1/19
403/169
5,617,931 A * 4/1997 Zygmun ..... E04G 3/30
182/145
6,264,001 B1 7/2001 Herschbach
6,296,077 B1 * 10/2001 Wood ..... E04G 5/16
182/186.8
6,360,490 B1 * 3/2002 Cotriss ..... B08B 15/02
52/138
6,976,557 B2 * 12/2005 Becker ..... E04G 5/14
182/113
8,104,579 B1 * 1/2012 Fu ..... E04G 1/12
182/186.8
8,931,594 B2 * 1/2015 Kreller ..... E04G 1/14
182/186.8
9,157,245 B2 * 10/2015 Thacker ..... E04G 7/307
2002/0036118 A1 * 3/2002 Ono ..... E04G 1/06
182/178.1
2003/0178253 A1 * 9/2003 Tatge ..... E04G 1/14
182/132
2005/0217936 A1 10/2005 Jolicoeur et al.
2006/0131107 A1 * 6/2006 Duguay ..... E04G 3/30
182/150
2014/0086669 A1 * 3/2014 Rogers ..... E04G 1/14
403/231

* cited by examiner

SUSPENDED SCAFFOLDING STRUCTURE AND CONNECTOR THEREFOR

CROSS-REFERENCE TO RELATED APPLICATIONS

This application is related and claims priority to U.S. Provisional Patent Application Ser. No. 61/823,290 filed May 14, 2013, which is hereby incorporated herein by reference in its entirety.

TECHNICAL FIELD

The present invention relates generally to scaffolding structures and connectors therefor. More specifically, the present invention relates to scaffolding structures and connectors which are adapted to be suspended from overhead anchor points.

BACKGROUND OF THE INVENTION

Scaffolding systems are widely known for use as modular support structures commonly used for access or support to elevated locations such as during construction or maintenance of structures such as buildings, bridges, walls, and monuments for example. Many scaffolding systems and components are typically designed and configured for structural support from a fixed surface below the scaffolding installation, such as the ground, or a platform of a building, for example. However, in circumstances requiring access to underlying or overhanging elevated surfaces of structures such as for the construction or maintenance of the underside of bridge decks, overhanging walls, or other overhead structures, supporting a scaffolding structure from a fixed surface below may be difficult or complicated, particularly if the overhead structure is at significant height, or extends over air or water, as in the case of bridges, overpasses or other common overhead structures, for example.

Customized movable truss systems have been developed for suspension from overhead suspension points allowing access to overhead structures, however such customized systems have typically required many single-purpose custom components which can be used only with matching components from the same custom supplier. Also, such customized suspendable systems have typically been expensive to purchase and use as they require purchase of many compatible customized components from a small number of specialized suppliers. Accordingly, there has been a desire for improved suspended scaffolding structures and systems to address some of the limitations of the scaffolding systems known in the art.

SUMMARY OF THE INVENTION

It is an object of the present invention to provide a suspended scaffolding connector that addresses some of the limitations of the prior art.

In accordance with one embodiment of the present invention, a suspended scaffolding connector is provided, that includes:

a central spine comprising: an anchor connector situated at a top end of the spine, a bottom lug situated substantially at a bottom end of the spine distal from the top end, and a top lug situated along the spine between the anchor connector and the bottom lug;

at least one top truss connector attached to the top lug and at least one bottom truss connector attached to the bottom lug, where the top and bottom truss connectors are configured and spaced for structural connection to corresponding top and bottom connectors of a scaffolding truss; and where the anchor connector is adapted for connection to a suspension anchor and to support the scaffolding truss through the top and bottom truss connectors.

According to a further related embodiment of the invention, a suspended scaffolding connector may also additionally comprise top and bottom ledger connectors attached to the spine and adapted for connection to a scaffolding ledger. In another embodiment, a suspended scaffolding connector may additionally comprise first and second secondary truss connectors attached to the spine between the top and bottom truss connectors, where the first and second secondary truss connectors are configured and spaced for structural connection to corresponding top and bottom connectors of a scaffolding truss.

A further object of the present invention is to provide a suspended scaffolding system that is adapted for suspension from overhead suspension anchor points, or for suspension above suspension anchor points underneath the system.

According to one aspect of the present invention, a suspended scaffolding system is provided, that includes:

a plurality of suspended scaffolding connectors each comprising an anchor connector at a top end of a central spine thereof, top and bottom truss connectors extending outward from the central spine, and top and bottom ledger connectors attached to the spine;

a plurality of scaffolding trusses connected between adjacent suspended scaffolding connectors in a first axial direction, where the top and bottom truss connectors of the scaffolding connectors are connected to corresponding top and bottom connections of the scaffolding trusses;

a plurality of scaffolding ledgers connected between adjacent suspended scaffolding connectors in a second lateral direction, where first and second ends of each of the scaffolding ledgers are connected to the top and bottom ledger connectors attached to the spine of each suspended scaffolding connector;

a plurality of deck platform sections attached to and spanning between adjacent scaffolding trusses in the lateral direction;

wherein each anchor connector is adapted for connection to a suspension anchor and to support the connected scaffolding trusses and attached deck platform sections.

According to a further related embodiment of the invention, the suspended scaffolding system may additionally comprise a plurality of cross-braces each comprising first and second ends, wherein the first and second ends of the cross-braces are each attached to the suspended scaffolding connectors. According to another embodiment, the anchor connectors of the suspended scaffolding system may be removably connected to the spine of each scaffolding connector. According to yet another embodiment, the anchor connectors of the suspended scaffolding system extend within the central spine of the scaffolding connectors extending downwards from the top end of the spine.

Further advantages of the invention will become apparent when considering the drawings in conjunction with the detailed description.

BRIEF DESCRIPTION OF THE DRAWINGS

The apparatus and method of the present invention will now be described with reference to the accompanying drawing figures, in which.

DETAILED DESCRIPTION OF THE INVENTION

Figure 1A:
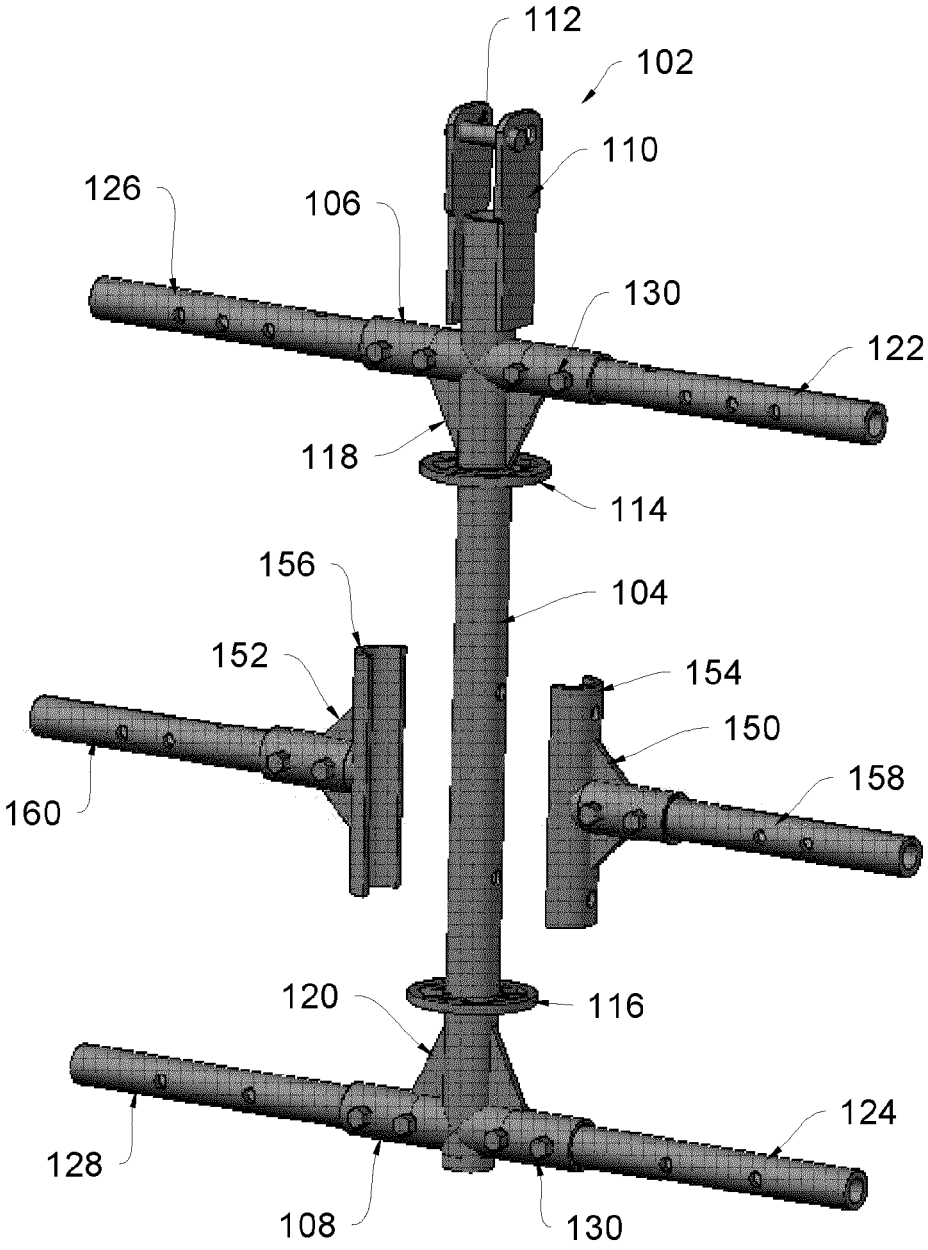
FIG. 1A is an isometric view of a suspended scaffolding connector, according to an embodiment of the present invention.
Figure 1B:
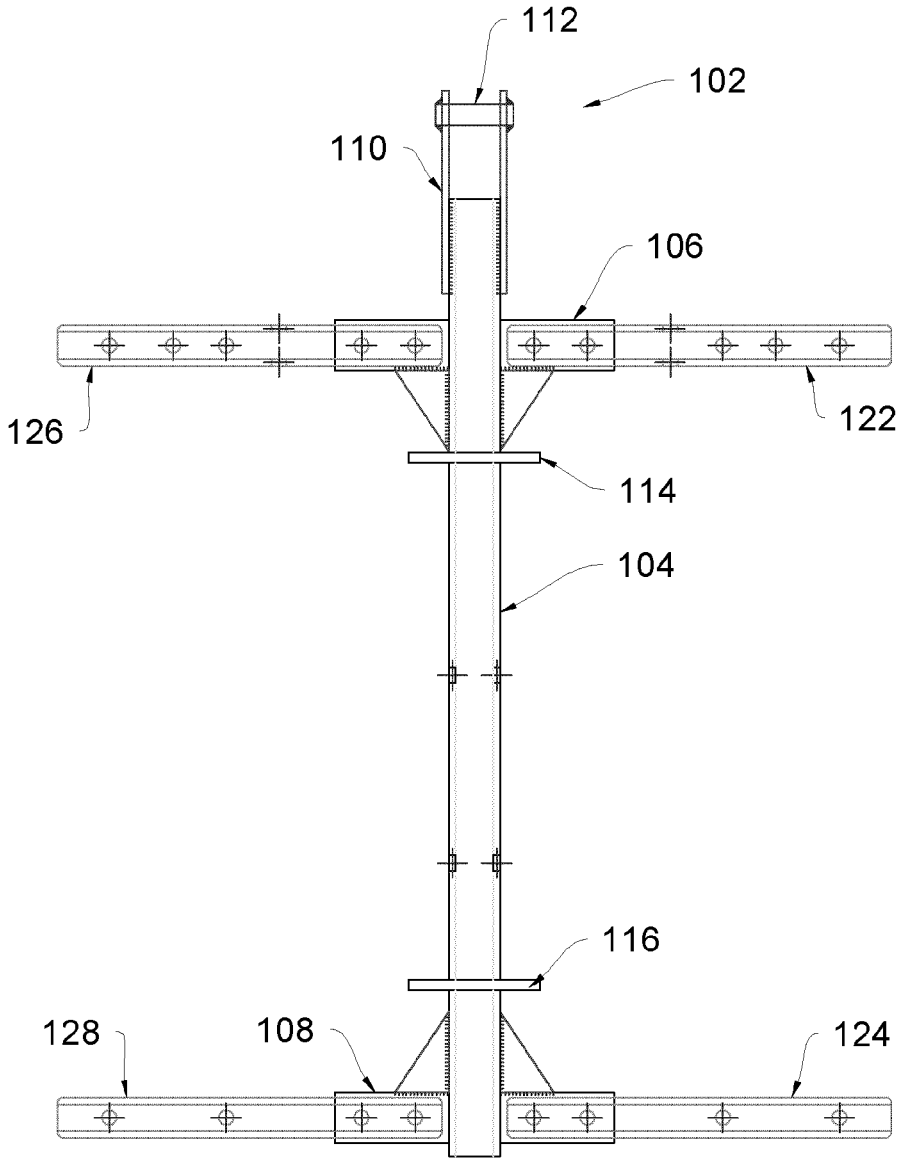
FIG. 1B is a front elevation view of the suspended scaffolding connector shown in FIG. 1A, according to an embodiment of the invention.
Figure 1C:
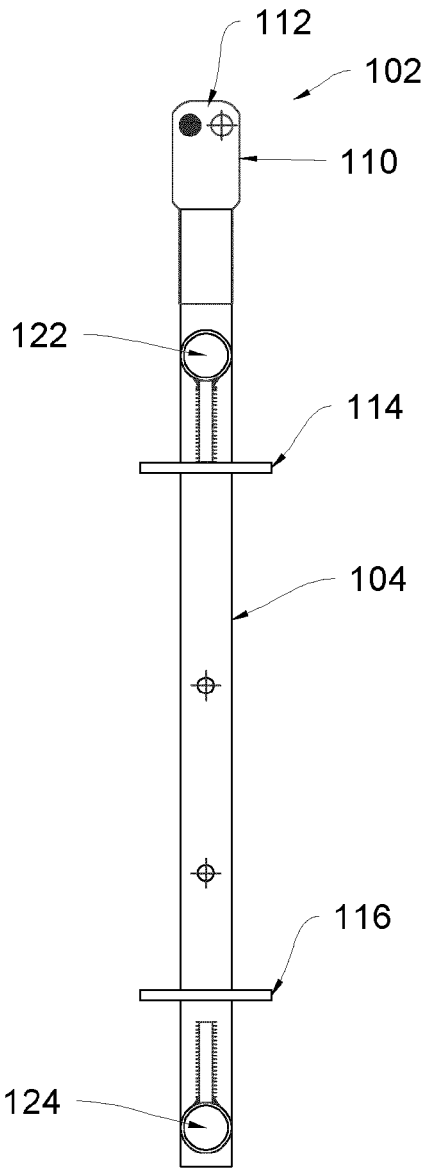
FIG. 1C is a side elevation view of the suspended scaffolding connector shown in FIG. 1A, according to an embodiment of the invention.

Referring to FIGS. 1A, 1B and 1C, an isometric view of a suspended scaffolding connector 102 is shown in FIG. 1A, according to an embodiment of the present invention. Front elevation and side elevation views of the suspended scaffolding connector 102 are shown in FIG. 1B and FIG. 1C, respectively, according to embodiments of the present invention. The suspended scaffolding connector 102 is adapted for suspension from at least one suitable anchor, and for connection to one or more scaffolding trusses to form a suspended scaffolding support structure, according to an embodiment of the present invention. Suspended scaffolding connector 102 comprises central spine 104, anchor bracket 110 connected to a top end of spine 104, lower lug 108 connected to spine 104 substantially at or near a bottom end thereof, and upper lug 106 connected to spine 104 between the lower lug 108 and anchor bracket 110. Anchor bracket 110 additionally comprises at least one anchor connector 112, such as at least one pin or bolt 112, which is adapted to connect the suspended scaffolding connector 102 to one or more anchors, such as a chain, cable, tube, screw or bar anchor, for example, to suspend the connector 102 such as from above. In one such embodiment, anchor connector 112 may comprise a suitably strong steel pin or bolt, such as one constructed of grade 8.8 structural steel, for example.

Suspended scaffolding connector 102 additionally comprises upper truss connectors 122 and 126 attached to upper lug 106 and extending outward on either side from spine 104, and lower truss connectors 124 and 128 connected to lower lug 108 and extending outward on either side from spine 104 in directions parallel to upper truss connectors 122 and 126. In one embodiment, upper and lower truss connectors 122, 124, 126, 128 may desirably be dimensioned to interconnect with the ends of a scaffolding truss, to allow for secure connection and support of the scaffolding truss by the suspended scaffolding connector 102. In a particular embodiment, cooperating upper and lower truss connectors extending from the same side of connector 102 (such as cooperating upper and lower truss connectors 122 and 124, or upper and lower connectors 126 and 128, for example) may desirably be dimensioned and spaced to connect to the end of a standardized scaffolding truss such as an aluminum scaffolding truss beam having a height of 780 mm, for example. In one such embodiment, cooperating upper and lower truss connectors 122, 124 or 126, 128, may be desirably dimensioned to fit within the ends of a scaffolding truss, such as a standardized scaffolding truss beam, to allow connection to the truss by means of one or more locking connectors inserted through one or more holes in the ends of the truss and corresponding holes in upper and lower truss connectors. In a particular such embodiment for use with a standard commercially available 780 mm height scaffolding truss beam, upper and lower truss connectors 122, 124, 126 and 128 may desirably comprise cylindrical members dimensioned for secure coaxial fitment inside the cylindrical ends of the scaffolding truss beam, and adapted for locking connection with one or more screw, bolt, pin or other suitable connectors extending through cooperating connection holes in the truss connectors 122, 124, 126 and 128 and the ends of the scaffolding truss beam. In an alternative embodiment, upper and lower truss connectors 122, 124, 126 and 128 may desirably comprise cylindrical members dimensioned for secure coaxial fitment outside and over the cylindrical ends of a scaffolding truss beam. In yet another embodiment suited for use with truss beams having differently configured connectors, the upper and lower truss connectors may be suitably shaped and dimensioned to cooperate with whichever truss beam connectors are preferred for use, such as square cross-section or other alternatively shaped truss connectors, for example.

According to an embodiment of the invention, connector 102 also comprises an upper ledger connector 114 and a lower ledger connector 116, each of which is connected to spine 104. Ledger connectors 114 and 116 may comprise any type of connector suitable for connection to a scaffolding ledger or brace member, as are commonly known in the field of scaffold systems. In one embodiment, upper and lower ledger connectors 114, 116 may comprise a single loop or ring connector suitable for connection to a conventional scaffolding ledger such as by means of a spring-loaded locking pin. In another embodiment, upper and lower ledger connectors 114, 116 may comprise a substantially circular or semi-circular disc or rosette connector with one or more holes or openings for connection with a scaffolding ledger or brace, such as by means of a spring-loaded locking pin. In a particular embodiment, upper ledger connector 114 may be attached to spine 104 below upper lug 108, and lower ledger connector 116 may be attached to spine 104 above lower lug 108.

Suspended scaffolding connector 102 may also comprise one or more upper reinforcing gussets 118 connected between the spine 104 and upper lug 106, and one or more lower reinforcing gussets 120 connected between spine 104 and lower lug 108, according to an embodiment of the invention. Reinforcing gussets 118, 120 may desirably be provided to strengthen the attachment of upper and lower lugs 106, 108 to spine 104, and therefore also to strengthen the attachment of upper truss connectors 122, 126 and lower truss connectors 124, 128 to spine 204 by means of lugs 106 and 108. In a particular embodiment, suspended scaffolding connector 102 may comprise two upper gussets 118 securely attached between spine 104 and upper lug 106, one on each side of spine 104 substantially parallel with truss supports 122 and 126, and two corresponding lower gussets 120 securely attached between spine 104 and lower lug 108, parallel to truss supports 124 and 128, for example. In a particular such embodiment, gussets 118, 120 may preferably be welded or otherwise permanently and securely attached to spine 104 and lugs 106, 108, so as to reinforce and strengthen the attachment of lugs 106, 108 to the spine 104, and allow for transfer of load from truss supports 122, 126, 124, 128 to spine 104, accordingly.

In one embodiment, suspended scaffolding connector 102 and its attached components as described above may be constructed out of a desirably light, strong, durable and affordable material, such as steel, aluminum, or other suitable metals or alloys, for example. In a particular embodiment, spine 104, lugs 106, 108, and truss connectors 122, 126, 124, 128 may be constructed out of suitably strong steel tubing, such as to provide for sufficient strength for suspension of connector 102 from a suitable anchor, and support of scaffolding trusses attached to truss connectors 122, 126, 124, 128, such as structural steel tubing made of steel having a strength of about 50 ksi, for example, and anchor connector 112 such as pin 112 may be constructed from suitable structural steel bar or bolt material, for example. Similarly, anchor bracket 110, ledger connectors 114, 116, and reinforcing gussets 118, 120 may be constructed out of suitably strong structural steel plate, such as 300W steel plate, for example. In one embodiment, lugs 106, 108, anchor bracket 110 and ledger connectors 114, 116 may be welded or otherwise suitably permanently and structurally attached to spine 104 so as to provide for secure structural connection. Truss connectors 122, 126, 124, 128 may be attached to lugs 106, 108 by one or more suitable removable fasteners 130, such as suitably strong steel bolts, nuts, bars or pins, for example, so as to provide for structurally strong connection to lugs 106, 108 and to enable support of scaffolding trusses attached to connectors 122, 126, 124, 128 by suspension from anchor connection 112 of spine 104, for example. In a particular embodiment, multiple steel bolts 130 passing through cooperating holes in both truss connectors 122, 126, 124, 128 and lugs 106, 108, may be used to securely and removably attach truss connectors 122, 126, 124, 128 to lugs 106, and 108. In one such embodiment, steel bolts 130 may comprise any suitably strong steel material and dimension, such as grade 8.8 structural steel bolts, for example. In another optional embodiment, truss connectors 122, 126, 124, 128 may be welded or otherwise suitably permanently structurally attached by any suitable permanent structural attachment means to lugs 106, 108.

In an optional embodiment, suspended scaffolding connector 102 may also comprise one or more optional additional, or secondary, truss connector members 150, 152. In one such embodiment, optional truss connector members 150, 152 may each comprise a truss connector 158, 160, attached to a corresponding spine connection bracket 154, 156, which may be shaped to allow for removable connection to spine 104 of the suspended scaffolding connector 102. In a particular such embodiment, optional truss connector members 150, 152 may be attachable extending on opposite sides from spine 104 at a position between upper lug 106 and lower lug 108 so as to provide for an intermediate connection point for connection of a scaffolding truss to optional truss connectors 158, 160. Such an intermediate scaffolding truss connection point may be desirable for use in connecting scaffolding trusses of differing dimensions such as commercially available aluminum scaffolding trusses of 780 mm and 450 mm heights, for example, or alternatively for connecting to a composite truss element that may comprise more than two connection points at each end, for example. Similar to as described above, optional truss connectors 158, 160 may be configured to cooperate with the ends of a scaffolding truss, such as to fit within the ends of a scaffolding truss, such as a standardized scaffolding truss beam, to allow connection to the truss by means of one or more locking connectors inserted through one or more holes in the ends of the truss and corresponding holes in optional truss connectors 158, 160. In a particular such embodiment for use with a commercially available scaffolding truss beams, optional truss connectors 158, 160 may desirably comprise cylindrical members dimensioned for secure coaxial fitment inside the cylindrical ends of the scaffolding truss beam, and adapted for locking connection with one or more screw, bolt, pin or other suitable connectors extending through cooperating connection holes in the optional truss connectors 158, 160 and the ends of the scaffolding truss beam.

In another embodiment of the invention, anchor connector 112 may be removable from anchor bracket 110, such as to allow for releasable connection to an anchor, and also to provide for insertion of an anchor extending down through the center of hollow connector spine 104 (such as a spine 104 constructed of structural tubing) such as for supporting the connector 102 from the bottom of spine 104, for example. In one such embodiment, anchor connector 112 may be removed, and a chain or bar anchor may be inserted down the center of spine 104 to protrude below the bottom end of spine 104 where the anchor may be secured to suspend connector 102 from its bottom. In a particular embodiment for operation with a steel bar anchor, the steel bar may extend through the spine 104 and may be capped with a support plate and locknut at its base where it protrudes from the bottom of spine 104, such as to suspend connector 102 from the base of spine 104. In another embodiment for use with a chain anchor, the chain may pass through the spine 104, and may be secured such as by a pin or other locking connector at the bottom of spine 104 to support the connector 102 from the bottom of spine 104. In an alternative embodiment, scaffolding connector 102 may be suspended and supported from below, such as by a support standard or bar extending up from a structure below where such supporting standard or bar may be inserted in the bottom of spine 104 to suspend and support the connector 102. In one such alternative embodiment, the suspended scaffolding connector 102 may be supported by standards from a structure such as a birdcage scaffolding structure located below, in order to support scaffolding trusses attached to the connector 102 above the birdcage scaffolding structure, for example.

Figure 2A:
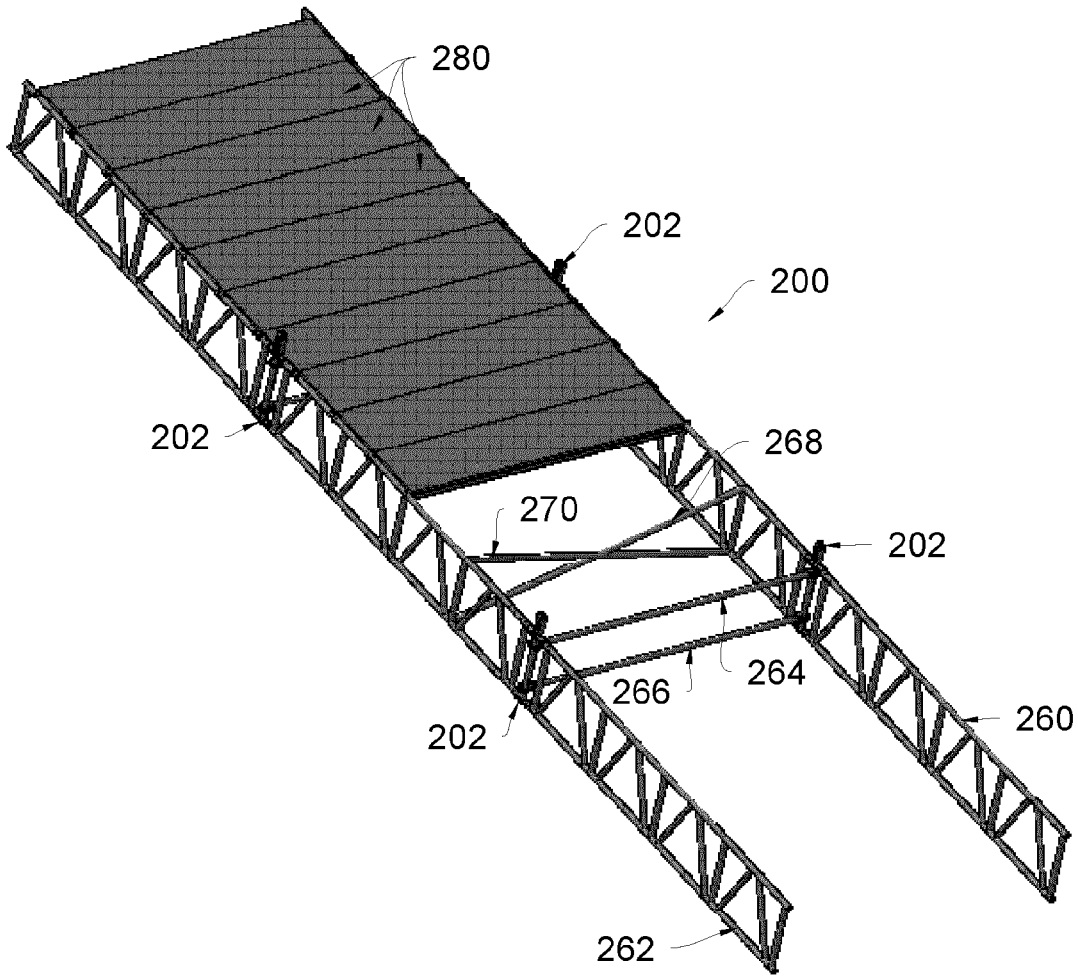
FIG. 2A is an isometric view of a suspended scaffolding system, according to an embodiment of the invention.
Figure 2B:
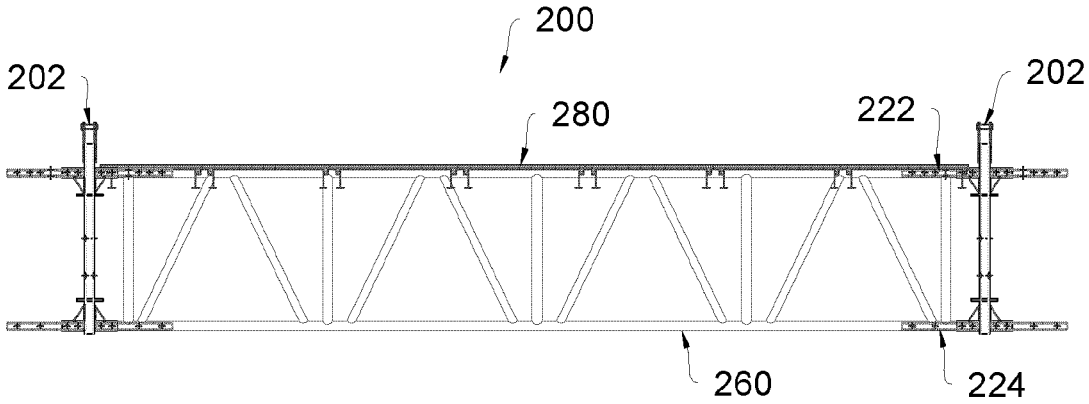
FIG. 2B is a front elevation view of the suspended scaffolding system shown in FIG. 2A, according to an embodiment of the invention.
Figure 2C:
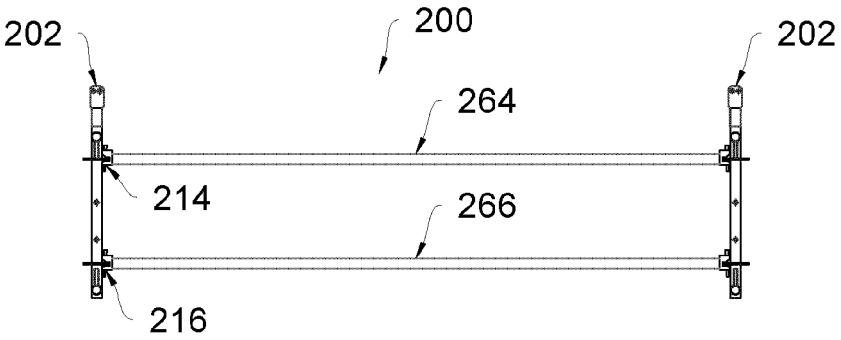
FIG. 2C is a cross-sectional side elevation view of the suspended scaffolding system shown in FIG. 2A, according to an embodiment of the invention.

Referring now to FIGS. 2A, 2B and 2C, an isometric view of a suspended scaffolding system 200 is shown in FIG. 2A, according to an embodiment of the invention. Front elevation and cross-sectional elevation views of the suspended scaffolding system 200 depicted in FIG. 2A are shown in FIG. 2B and FIG. 2C, respectively, according to embodiments of the present invention. According to one embodiment of the present invention, suspended scaffolding system 200 comprises suspended scaffolding connectors 202 which connect one or more scaffolding trusses, such as scaffolding truss beams 260, 262 on opposite lateral sides of the scaffolding system 200. The suspended scaffolding connectors 202 are then suspended or supported from at least one suitable anchor, such as by connection to the anchor at a top end of scaffolding connectors 202, to suspend the system 200 from above. Suspended scaffolding system 200 additionally comprises scaffold ledgers or braces 264, 266 which are connected between two cooperating connectors 202 located directly across from each other on opposite lateral sides of the system 200, such as to provide lateral spacing and bracing of the trusses 260, 262. System 200 further comprises deck platforms 280 which are connected to and supported by the upper surface of the scaffolding truss beams 260, 262 such as to desirably provide a suspended working surface for suspension beneath an existing structure. The suspended working surface formed by deck platforms 280 may desirably provide for secure and safe access to the underside of existing structures, such as for construction, maintenance and other access requirements under bridges, overpasses, overhangs and other such overhead structures. In a further embodiment, system 200 may further comprise additional adjacent rows of scaffolding trusses connected with suspended scaffolding connectors 202 and supporting multiple adjacent connected rows of deck platforms 280, to provide a grid of connectors 202 and trusses and a configurably dimensioned suspended work surface of deck platforms 280 to meet any desired size requirements. In a particular embodiment, standard 780 mm height aluminum scaffolding trusses 260, 262 of nominal 14 ft length and standard scaffolding ledgers 464, 466 of nominal 10 ft length may be connected by suspended scaffolding connectors 202 to provide a system 200 with connectors 202 on a 14 ft by 10 ft grid for suspending a work surface of any desired dimensions. In one such embodiment, such a 14 ft by 10 ft connector grid may provide for a nominal standard suspended deck loading of 75 lb/sq. ft. as may be commercially accepted for heavy duty scaffold systems, for example.

In one embodiment, suspended scaffolding connectors 202 of suspended scaffolding system 200 may comprise connectors 202 which are configured substantially as described above with reference to FIGS. 1A, 1B, and 1C, and each connector 202 may comprise upper and lower truss connectors 222, 224 for cooperating connection with the upper ends of scaffolding truss beams 260, 262. As described above, such connection may comprise the coaxial insertion of truss connectors 222, 224 within the upper and lower ends of truss beam 260, and use of one or more removable locking connectors such as bolts or bars to securely fasten and support truss beam 260 to suspended scaffolding connectors 202 at each end of the truss beam 260. Additionally, suspended scaffolding connectors 202 may comprise scaffolding ledger connectors 214, 216 for cooperating connection with the ends of ledgers or braces 264, 266. Ledgers or braces 264, 266 may thereby be preferably releasably and securely connected to ledger connectors 214, 216 by conventionally available fasteners or connectors, such as a spring-loaded locking pin, for example.

In a particular embodiment, suspended scaffolding system 200 may also comprise cross-brace members 268, 270. In one such embodiment, cross-brace members 268, 270 may be attached at each end to opposite scaffolding truss beams located across from each other on opposite lateral sides of structure 200, such as to provide for additional cross-bracing and support of the truss beams and overall structure 200. In a preferred embodiment, cross-brace members 268 and 270 may be desirably oriented in a diagonal direction between a top rail of one truss beam, and a bottom rail of the opposite truss beam, so as to provide cross-bracing support.

In an alternative embodiment, the suspended scaffolding connectors 202 of system 200 may be configured to provide for insertion of an anchor extending down through the center of hollow connectors 202 (such as when connector 202 is constructed of structural tubing) such as for supporting the connector 202 from the bottom thereof, for example. In one such embodiment, a chain or bar anchor may be inserted down the center of connector 202 to protrude below the bottom end thereof where the anchor may be secured to suspend connector 202 from its bottom. In a particular embodiment for operation with a steel bar anchor, the steel bar may extend through anchor 202 and may be capped with a support plate and locknut at its base where it protrudes from the bottom thereof, such as to suspend connector 202 from its base. In another embodiment for use with a chain anchor, the chain may pass through the connector 202, and may be secured such as by a pin or other locking connector at the bottom of connector 202 to support the connector 202 from its base. In an alternative embodiment, suspended scaffolding system 200 and corresponding suspended scaffolding connectors 202 may be suspended and supported from below, such as by a support standard or bar extending up from a structure below where such supporting standard or bar may be inserted in the bottom of connectors 202 to suspend and support each connector 202 from below. In one such alternative embodiment, the suspended scaffolding connectors 202 may be supported by standards from a structure such as a birdcage scaffolding structure located below, in order to support suspended scaffolding system 200 above the birdcage scaffolding structure, for example.

Figure 3A:
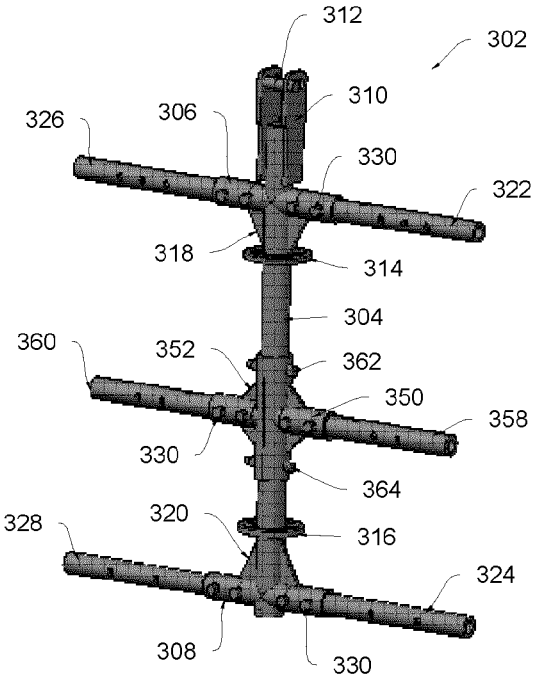
FIG. 3A is an isometric view of another suspended scaffolding connector, according to a further embodiment of the present invention.
Figure 3B:
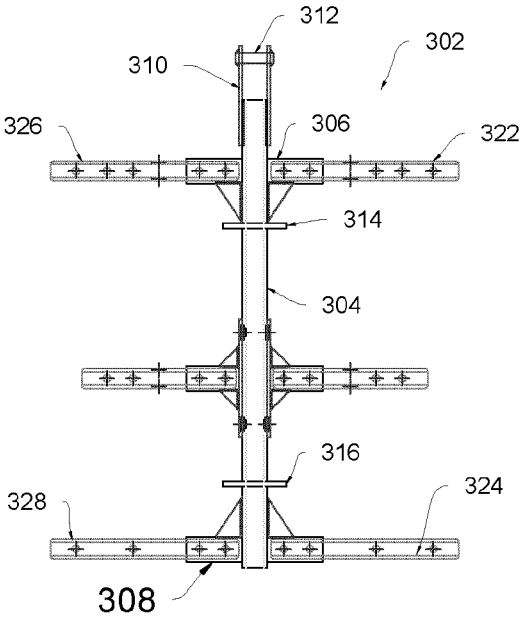
FIG. 3B is a front elevation view of the suspended scaffolding connector shown in FIG. 3A, according to an embodiment of the invention.

Referring now to FIGS. 3A and 3B, an isometric view of a suspended scaffolding connector 302 is shown in FIG. 3A, according to another embodiment of the present invention. A front elevation view of the suspended scaffolding connector 302 is shown in FIG. 3B, according to an embodiment of the invention. Similar to connector 102 described above, the suspended scaffolding connector 302 is adapted for suspension from at least one suitable anchor, and for connection to one or more scaffolding trusses to form a suspended scaffolding support structure, according to an embodiment of the present invention. Suspended scaffolding connector 302 comprises central spine 304, anchor bracket 310 connected to a top end of spine 304, lower lug 308 connected to spine 304 at a bottom end thereof, and upper lug 306 connected to spine 304 between the lower lug 308 and anchor bracket 310. Anchor bracket 310 additionally comprises at least one anchor connector 312, such as at least one pin or bolt 312, which is adapted to connect the suspended scaffolding connector 302 to one or more anchors, such as a chain, cable, tube, screw or bar anchor, for example, to suspend the connector 302 such as from above. In one such embodiment, anchor connector 312 may comprise a suitably strong steel pin or bolt, such as one constructed of grade 8.8 structural steel, for example.

Suspended scaffolding connector 302 additionally comprises upper truss connectors 322 and 326 attached to upper lug 306 and extending outward on either side from spine 304, and lower truss connectors 324 and 328 connected to lower lug 308 and extending outward on either side from spine 304 in directions parallel to upper truss connectors 322 and 326. Suspended scaffolding connector 302 additionally comprises intermediate truss connectors 358, 360, attached to spine 304 by spine connection brackets 350 and 352, respectively. In one such embodiment, intermediate spine connection brackets 350, 352 may be shaped to allow for secure connection to spine 304, such as by spine connection bolts or pins 362, 364, extending through corresponding holes in spine connection brackets 350, 352 and spine 304, for example. In one embodiment, spine connection bolts or pins 362, 364 may comprise any suitably strong material and dimension, such as grade 8.8 structural steel bolts, for example In one embodiment, upper and lower truss connectors 322, 324, 326, 328 may desirably be dimensioned to interconnect with the ends of a scaffolding truss, to allow for secure connection and support of the scaffolding truss by the suspended scaffolding connector 302. In a particular embodiment, cooperating upper and lower truss connectors extending from the same side of connector 302 (such as cooperating upper and lower truss connectors 322 and 324, or upper and lower connectors 326 and 328, for example) may desirably be dimensioned and spaced to connect to the end of a standardized scaffolding truss such as an aluminum scaffolding truss beam having a height of 780 mm, for example. In one such embodiment, cooperating upper and lower truss connectors 322, 324 or 326, 328, may be desirably dimensioned to fit within the ends of a scaffolding truss, such as a standardized scaffolding truss beam, to allow connection to the truss by means of one or more locking connectors inserted through one or more holes in the ends of the truss and corresponding holes in upper and lower truss connectors. In a particular such embodiment for use with a standard commercially available 780 mm height scaffolding truss beam, upper and lower truss connectors 322, 324, 326 and 328 may desirably comprise cylindrical members dimensioned for secure coaxial fitment inside the cylindrical ends of the scaffolding truss beam, and adapted for locking connection with one or more screw, bolt, pin or other suitable connectors extending through cooperating connection holes in the truss connectors 322, 324, 326 and 328 and the ends of the scaffolding truss beam. In an alternative embodiment, upper and lower truss connectors 322, 324, 326 and 328 may desirably comprise cylindrical members dimensioned for secure coaxial fitment outside and over the cylindrical ends of a scaffolding truss beam. In yet another embodiment suited for use with truss beams having differently configured connectors, the upper and lower truss connectors may be suitably shaped and dimensioned to cooperate with whichever truss beam connectors are preferred for use, such as square cross-section or other alternatively shaped truss connectors, for example.

In a particular such embodiment, intermediate truss connectors 358, 360, may be desirably aligned substantially parallel to upper and/or lower truss connectors 322, 326, 324, 328, for example, and may be desirably spaced from the upper and/or lower truss connectors to be dimensioned for use with a standard scaffolding truss beam. In one embodiment, intermediate truss connectors 358, 360 may be attached and extend on opposite sides from spine 304 at a position between upper lug 306 and lower lug 308 so as to provide for an intermediate connection point for connection of a scaffolding truss to intermediate truss connectors 358, 360. Such an intermediate scaffolding truss connection point may be desirable for use in connecting scaffolding trusses of differing dimensions such as commercially available aluminum scaffolding trusses of 780 mm or 450 mm heights, for example, or alternatively for connecting to a composite truss element that may comprise more than two connection points at each end, for example. Similar to as described above, intermediate truss connectors 358, 360 may be configured to cooperate with the ends of a scaffolding truss, such as to fit within the ends of a scaffolding truss, to allow connection to the truss by means of one or more locking connectors inserted through one or more holes in the ends of the truss and corresponding holes in intermediate truss connectors 358, 360. In a particular such embodiment for use with a standard commercially available 450 mm height aluminum scaffolding truss beam, intermediate truss connectors 358, 360 may desirably comprise cylindrical members dimensioned for secure coaxial fitment inside the cylindrical ends of the scaffolding truss beam, and adapted for locking connection with one or more screw, bolt, pin or other suitable connectors extending through cooperating connection holes in the intermediate truss connectors 358, 360, and either of the upper and lower truss connectors 322, 326 or 324, 328, and the ends of the scaffolding truss beam. In one embodiment, spine connection bolts 362, 364 may be removable, so as to provide for removable connection of brackets 362, 364 to spine 304 of the suspended scaffolding connector 302.

Similar to as described above, suspended scaffolding connector 302 also comprises an upper ledger connector 314 and a lower ledger connector 316, each of which is connected to spine 304. Ledger connectors 314 and 316 may comprise any type of connector suitable for connection to a scaffolding ledger or brace member, as are commonly known in the field of scaffold systems. In one embodiment, upper and lower ledger connectors 314, 316 may comprise a single loop or ring connector suitable for connection to a conventional scaffolding ledger such as by means of a spring-loaded locking pin. In another embodiment, upper and lower ledger connectors 314, 316 may comprise a substantially circular or semi-circular disc or rosette connector with one or more holes or openings for connection with a scaffolding ledger or brace, such as by means of a spring-loaded locking pin. In a particular embodiment, upper ledger connector 314 may be attached to spine 304 below upper lug 308, and lower ledger connector 316 may be attached to spine 304 above lower lug 308.

Suspended scaffolding connector 302 may also comprise one or more upper reinforcing gussets 318 connected between the spine 304 and upper lug 306, and one or more lower reinforcing gussets 320 connected between spine 304 and lower lug 308, and may also comprise one of more intermediate reinforcing gussets connected between the spine connection brackets 350, 352 and the intermediate truss connectors 358, 360, according to an embodiment of the invention.

Similar to as described above in reference to connector 102, in one embodiment, suspended scaffolding connector 302 and its attached components as described above may be constructed out of a desirably light, strong, durable and affordable material, such as steel, aluminum, or other suitable metals or alloys, for example. In a particular embodiment, spine 304, lugs 306, 308, and truss connectors 322, 326, 324, 328, 358, 360, may be constructed out of suitably strong steel tubing, such as to provide for sufficient strength for suspension of connector 302 from a suitable anchor, and support of scaffolding trusses attached to truss connectors 322, 326, 324, 328, 358, 360, such as structural steel tubing made of steel having a strength of about 50 ksi, for example, and anchor connector 312 such as pin 312 may be constructed from suitable structural steel bar or bolt material, for example. Similarly, anchor bracket 310, ledger connectors 314, 316, and reinforcing gussets 318, 320 may be constructed out of suitably strong structural steel plate, such as 300W steel plate, for example. In one embodiment, lugs 306, 308, anchor bracket 310 and ledger connectors 314, 316 may be welded or otherwise suitably permanently and structurally attached to spine 304 so as to provide for secure structural connection. Truss connectors 322, 326, 324, 328, 358, 360 may be attached to lugs 306, 308 and spine connector brackets 350, 352 by one or more suitable removable fasteners 330, such as suitably strong steel bolts, nuts, bars or pins, for example, so as to provide for structurally strong connection to lugs 306, 308 and brackets 350, 352, and to enable support of scaffolding trusses attached to connectors 322, 326, 324, 328, 358 or 360 by suspension from anchor connection 312 of spine 304, for example. In one such embodiment, steel bolts 330 may comprise any suitably strong steel material and dimension, such as grade 8.8 structural steel bolts, for example. In another optional embodiment, truss connectors 322, 326, 324, 328, 358, 360 may be welded or otherwise suitably permanently structurally attached to lugs 306, 308 or brackets 350, 352.

Similar to as described above in reference to connector 102, in an alternative embodiment, scaffolding connector 302 may be suspended and supported from below, such as by a support standard or bar extending up from a structure below where such supporting standard or bar may be inserted in the bottom of spine 304 to suspend and support the connector 302. In one such alternative embodiment, the suspended scaffolding connector 302 may be supported by standards from a structure such as a birdcage scaffolding structure located below, in order to support scaffolding trusses attached to the connector 302 above the birdcage scaffolding structure, for example.

Figure 4A:
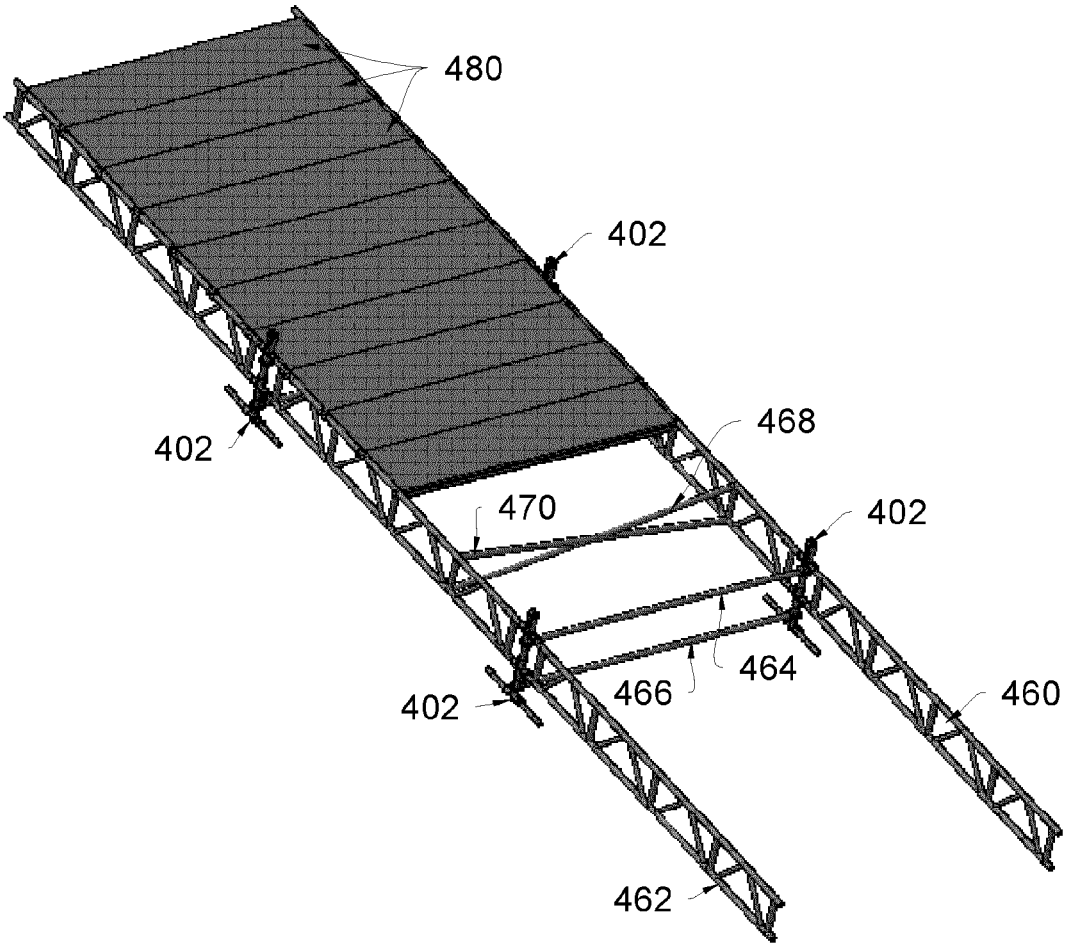
FIG. 4A is an isometric view of another suspended scaffolding system, according to another embodiment of the invention.
Figure 4B:
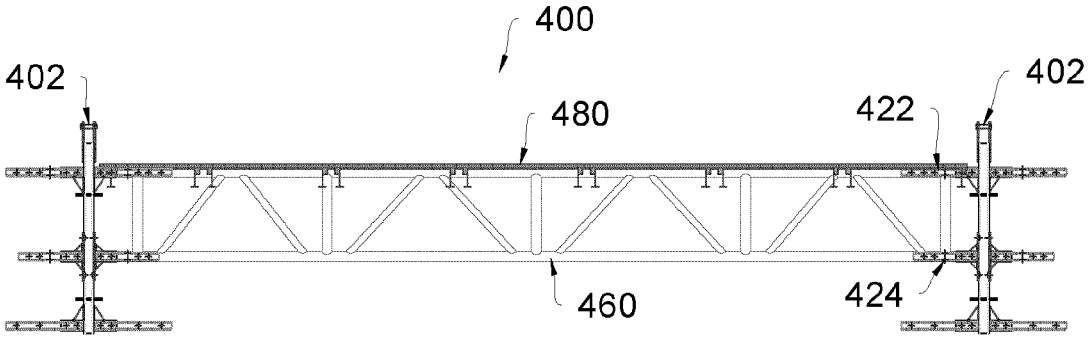
FIG. 4B is a front elevation view of the suspended scaffolding system shown in FIG. 4A, according to an embodiment of the invention.
Figure 4C:
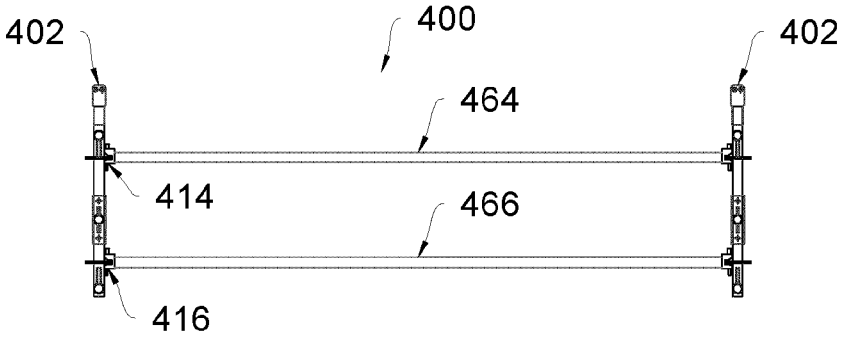
FIG. 4C is a cross-sectional side elevation view of the suspended scaffolding system shown in FIG. 4A, according to an embodiment of the invention.

Referring now to FIGS. 4A, 4B and 4C, an isometric view of a suspended scaffolding system 400 is shown in FIG. 4A, according to an embodiment of the invention. Front elevation and cross-sectional elevation views of the suspended scaffolding system 400 depicted in FIG. 4A are shown in FIG. 4B and FIG. 4C, respectively, according to embodiments of the present invention. According to one embodiment of the present invention, similar to system 200 described above, suspended scaffolding system 400 comprises suspended scaffolding connectors 402 which connect one or more scaffolding trusses, such as scaffolding truss beams 460, 462 on opposite lateral sides of the scaffolding system 400. The suspended scaffolding connectors 402 are then suspended or supported from at least one suitable anchor, such as by connection to the anchor at a top end of scaffolding connectors 402, to suspend the system 400 from above. Suspended scaffolding system 400 additionally comprises scaffold ledgers or braces 464, 466 which are connected between two cooperating connectors 402 located directly across from each other on opposite lateral sides of the system 400, such as to provide lateral spacing and bracing of the trusses 460, 462. System 400 further comprises deck platforms 480 which are connected to and supported by the upper surface of the scaffolding truss beams 460, 462 such as to desirably provide a suspended working surface for suspension beneath an existing structure. In a further embodiment, system 400 may further comprise additional adjacent rows of scaffolding trusses connected with suspended scaffolding connectors 402 and supporting multiple adjacent connected rows of deck platforms 480, to provide a grid of connectors 402 and trusses and a configurably dimensioned suspended work surface of deck platforms 480 to meet any desired size requirements. In a particular embodiment, standard 450 mm height aluminum scaffolding trusses 460, 462 of nominal 14 ft length and standard scaffolding ledgers 464, 466 of nominal 10 ft length may be connected by suspended scaffolding connectors 402 to provide a system 400 with connectors 402 on a 14 ft by 10 ft grid for suspending a work surface of any desired dimensions.

In one embodiment, suspended scaffolding system 400 may comprise connectors 402 which are configured substantially as described above with reference to FIGS. 3A and 3B, and each connector 402 may comprise upper and lower truss connectors 422, 424 for cooperating connection with the upper ends of scaffolding truss beams 460, 462. As described above, such connection may comprise the coaxial insertion of truss connectors 422, 424 within the upper and lower ends of truss beam 460, and use of one or more removable locking connectors such as bolts or bars to securely fasten and support truss beam 460 to suspended scaffolding connectors 402 at each end of the truss beam 460. Additionally, suspended scaffolding connectors 402 may comprise scaffolding ledger connectors 414, 416 for cooperating connection with the ends of ledgers or braces 464, 466. Ledgers or braces 464, 466 may thereby be preferably releasably and securely connected to ledger connectors 414, 416 by conventionally available fasteners or connectors, such as a spring-loaded locking pin, for example.

In a particular embodiment, suspended scaffolding system 400 may also comprise cross-brace members 468, 470. In one such embodiment, cross-brace members 468, 470 may be attached at each end to opposite scaffolding truss beams located across from each other on opposite lateral sides of structure 400, such as to provide for additional cross-bracing and support of the truss beams and overall structure 400. In a preferred embodiment, cross-brace members 468 and 470 may be desirably oriented in a diagonal direction between a top rail of one truss beam, and a bottom rail of the opposite truss beam, so as to provide cross-bracing support.

In an alternative embodiment, similar to as described above in reference to suspended scaffolding system 200, the suspended scaffolding connectors 402 of system 400 may be configured to provide for insertion of an anchor extending down through the center of hollow connectors 402 (such as when connector 402 is constructed of structural tubing) such as for supporting the connector 402 from the bottom thereof, for example. In another alternative embodiment, suspended scaffolding system 400 and corresponding suspended scaffolding connectors 402 may be suspended and supported from below, such as by a support standard or bar extending up from a structure below where such supporting standard or bar may be inserted in the bottom of connectors 402 to suspend and support each connector 402 from below, such as from a birdcage scaffolding structure, for example.

Figure 5A:
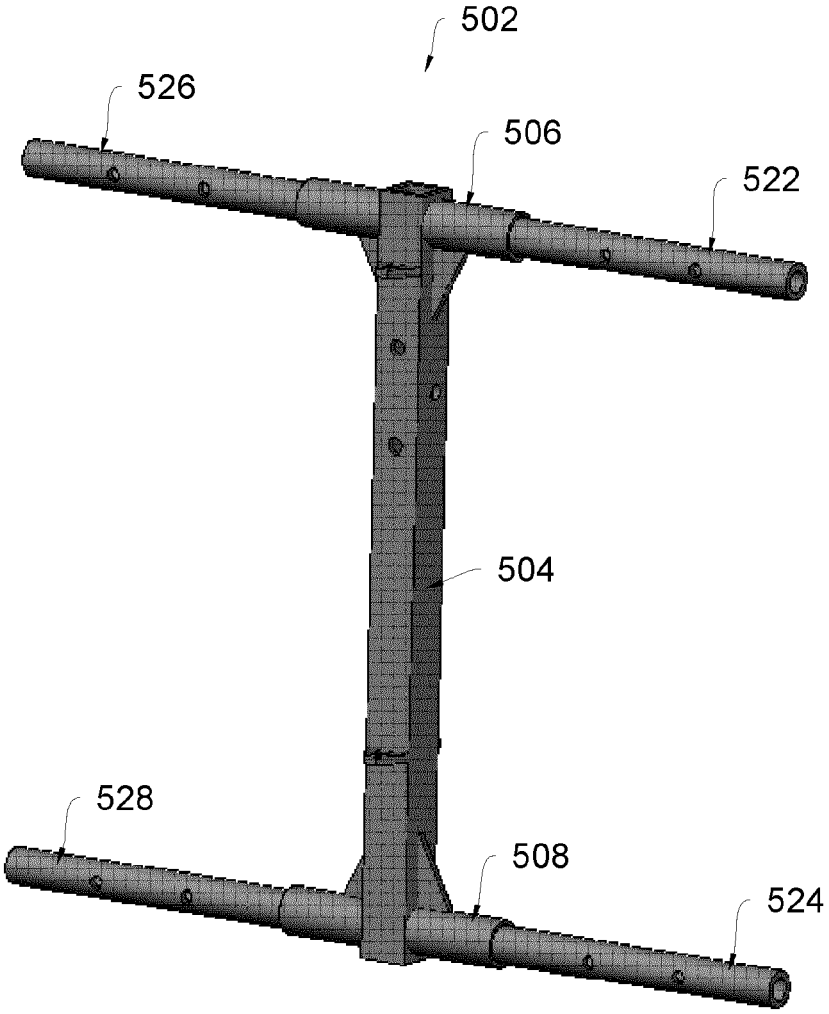
FIG. 5A is an isometric view of a suspended scaffolding truss connector, according to an embodiment of the invention.
Figure 5B:
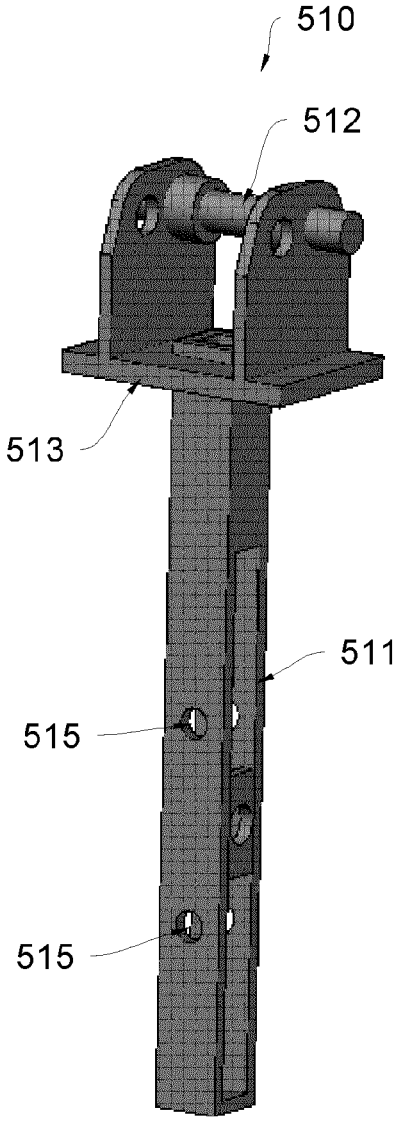
FIG. 5B is an isometric view of a suspended scaffolding suspension connector, according to an embodiment of the invention.
Figure 5C:
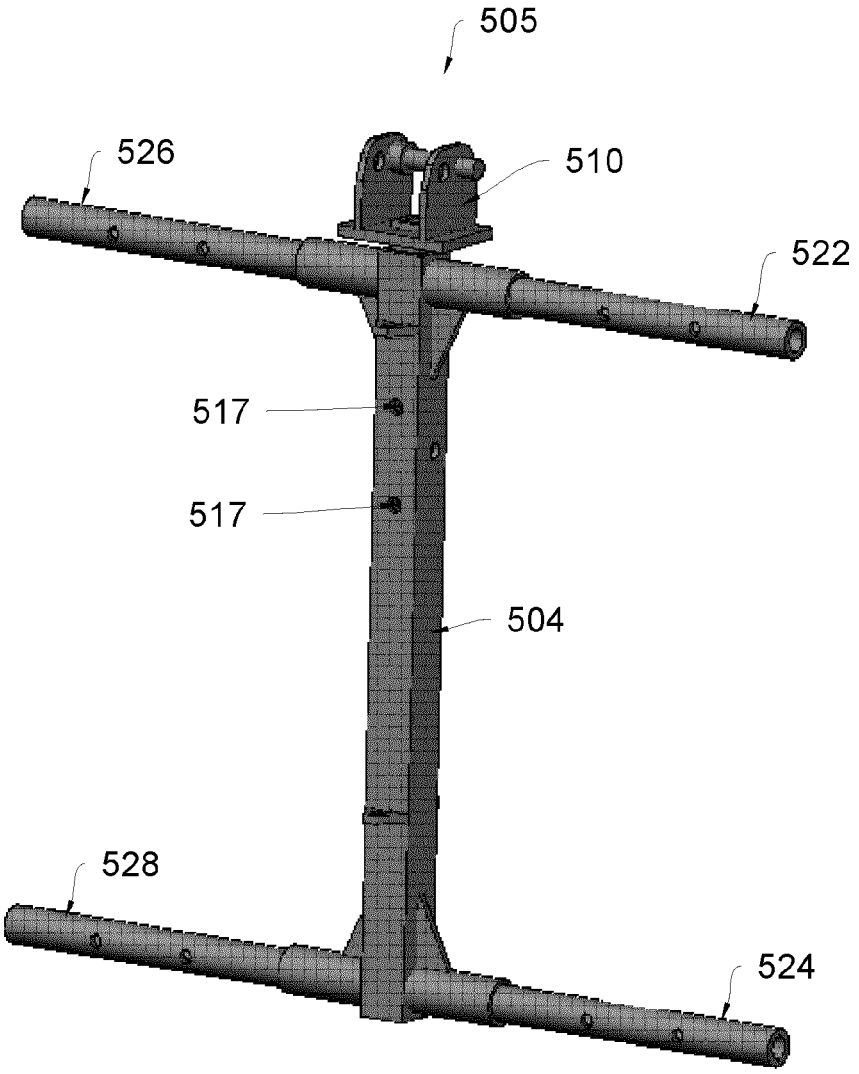
FIG. 5C is an isometric view of an assembled scaffolding suspension connector, according to an embodiment of the invention.

Referring now to FIGS. 5A, 5B and 5C, an isometric view of a suspended scaffolding truss connector 502 is shown in FIG. 5A, according to another embodiment of the present invention. An isometric view of a suspension connector 510 suitable for connection to and use with truss connector 502 is shown in FIG. 5B, according to an embodiment of the invention. An isometric view of an assembled suspended scaffolding connector 505 comprising assembled and connected truss connector 502 and suspension connector 510 is shown in FIG. 5C, according to an embodiment of the present invention. Assembled suspended scaffolding connector 505 is adapted for suspension from at least one suitable anchor, and for connection to one or more scaffolding trusses to form a suspended scaffolding support structure, according to an embodiment of the present invention. Suspended scaffolding connector 505 comprises truss connector 502, and suspension connector 510. Truss connector 502 comprises a central spine 504, lower lug 508 connected to spine 504 at a bottom end thereof, and upper lug 506 connected to spine 504 at an upper end thereof. Suspension connector 510 comprises suspension spine 511, anchor bracket 513 connected to the top of suspension spine 511, and anchor connector 512, such as at least one bolt or pin 512 connected to bracket 513 and adapted to connect the suspended scaffolding connector 505 to one or more anchors, such as a chain, cable, tube, screw or bar anchor, for example, to suspend the connector 505 such as from above.

Truss connector 502 additionally comprises upper truss connectors 522 and 526 attached to upper lug 506 and extending outward on either side from spine 504, and lower truss connectors 524 and 528 connected to lower lug 508 and extending outward on either side from spine 504 in directions parallel to upper truss connectors 522 and 526.

Similar to as described above in reference to suspended scaffolding connector 102, in one embodiment, upper and lower truss connectors 522, 524, 526, 528 may desirably be dimensioned to interconnect with the ends of a scaffolding truss, to allow for secure connection and support of the scaffolding truss by the suspended scaffolding connector 505. In a particular embodiment, cooperating upper and lower truss connectors extending from the same side of truss connector 502 (such as cooperating upper and lower truss connectors 522 and 524, or upper and lower connectors 526 and 528, for example) may desirably be dimensioned and spaced to connect to the end of a standardized scaffolding truss such as an aluminum scaffolding truss beam having a height of 780 mm, or 450 mm, for example. In one such embodiment, cooperating upper and lower truss connectors 522, 524 or 526, 528, may be desirably dimensioned to fit within the ends of a scaffolding truss, such as a standardized scaffolding truss beam, to allow connection to the truss by means of one or more locking connectors inserted through one or more holes in the ends of the truss and corresponding holes in upper and lower truss connectors. In yet another embodiment suited for use with truss beams having differently configured connectors, the upper and lower truss connectors may be suitably shaped and dimensioned to cooperate with whichever truss beam connectors are preferred for use, such as square cross-section or other alternatively shaped truss connectors, for example.

According to one embodiment, truss connector 502 and suspension connector 510 may be securely connected to each other, such as by coaxial mating connection of suspension connector 510 inside the hollow shaft of spine 504 of truss connector 502, and may be secured by any suitable locking apparatus, such as bolts or pins through cooperating holes 515 in suspension connector 510 and holes 517 in truss connector 502, for example. In such a manner, a suitable anchor attached to anchor connector 512 of suspension connector 510 may desirably suspend and support one or more scaffolding trusses connected to truss connectors 522, 526, 524 and 528 of suspended truss connector 502, such as to support a suspended work platform on top of the scaffolding trusses.

Similar to as described above in reference to connector 102, in one embodiment, suspended scaffolding connector 505 and its attached components as described above may be constructed out of a desirably light, strong, durable and affordable material, such as steel, aluminum, or other suitable metals or alloys, for example. In a particular embodiment, spine 504 and suspension connector spine 511 may be constructed out of suitably strong rectangular steel tubing adapted for fitting of suspension connector 510 inside spine 504 of truss connector 502. In another embodiment, spines 504, 511, lugs 506, 508, and truss connectors 522, 526, 524, 528 may be constructed out of suitably strong steel tubing, such as to provide for sufficient strength for suspension of connector 505 from a suitable anchor, and support of scaffolding trusses attached to truss connectors 522, 526, 524, 528, such as structural steel tubing made of steel having a strength of about 50 ksi, for example, and anchor connector 512 such as pin 512 may be constructed from suitable structural steel bar or bolt material, for example. Similarly, anchor bracket 510, and optional reinforcing gussets such as between lugs 508, 508 and spine 504, may be constructed out of suitably strong structural steel plate, such as 300W steel plate, for example. In one embodiment, lugs 506, 508, and anchor bracket 510 may be welded or otherwise suitably permanently and structurally attached to spines 504 and 511, respectively, so as to provide for secure structural connection.

Similar to as described above in reference to connector 102, in an alternative embodiment, suspended scaffolding connector 505 may be suspended and supported from below, such as by a support standard or bar extending up from a structure below where such supporting standard or bar may be inserted in the bottom of spine 504 to suspend and support the connector 505. In one such alternative embodiment, the suspended scaffolding connector 505 may be supported by standards from a structure such as a birdcage scaffolding structure located below, in order to support scaffolding trusses attached to the connector 505 above the birdcage scaffolding structure, for example.

The exemplary embodiments herein described are not intended to be exhaustive or to limit the scope of the invention to the precise forms disclosed. They are chosen and described to explain the principles of the invention and its application and practical use to allow others skilled in the art to comprehend its teachings.

As will be apparent to those skilled in the art in light of the foregoing disclosure, various equivalent alterations and modifications are possible in the practice of this invention without departing from the scope of the disclosure.

Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment. Further, the described features, structures, or characteristics of the present disclosure may be combined in any suitable manner in one or more embodiments. In this Detailed Description of the Invention, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure.

The scope of the present disclosure fully encompasses other embodiments and is to be limited, accordingly, by nothing other than the appended claims, wherein any reference to an element being made in the singular is intended to mean "one or more", and is not intended to mean "one and only one" unless explicitly so stated. All structural and functional equivalents to the elements of the above-described preferred embodiment and additional embodiments are hereby expressly incorporated by reference and are intended to be encompassed by the present claims. Moreover, no requirement exists for an apparatus or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, are also encompassed by the present disclosure.

What is claimed is:

1. A suspended scaffolding connector comprising:

a central spine;

an anchor connector at a top end of the spine;

a lower set of truss connectors attached to the spine at a first location spaced apart from the top end of the spine, the lower set of truss connectors comprising first and second co-axial lower truss connectors, the first lower truss connector comprising a first straight elongated member rigidly projecting perpendicular to the spine in a first direction and the second lower truss connector comprising a second straight elongated member rigidly projecting perpendicular to the spine in a second direction, the second direction opposite the first direction; and an upper set of truss connectors attached to the spine at a second location between the lower set of truss connectors and the top end of the spine, the upper set of truss connectors comprising first and second co-axial upper truss connectors, the first upper truss connector comprising a third straight elongated member rigidly projecting perpendicular to the spine in the first direction and the second upper truss connector comprising a fourth straight elongated member rigidly projecting perpendicular to the spine in the second direction, the upper truss connectors projecting co-planar with and parallel to the lower truss connectors, wherein, the upper and lower first truss connectors are spaced apart to respectively releasably engage upper and lower members of a first scaffolding truss extending rigidly in the first direction and the upper and lower second truss connectors are spaced apart to respectively releasably engage upper and lower members of a second scaffolding truss extending rigidly in the second direction such that, when suspended from an overhead suspension point by the anchor connector, and when the upper and lower first truss connectors are engaged with the first scaffolding truss and the upper and lower second truss connectors are engaged with the second scaffolding truss the suspended scaffolding connector supports a portion of a suspended scaffolding structure comprising the first and second scaffolding trusses; wherein the upper and lower sets of truss connectors are respectively supported by upper and lower sets of lugs: the lower set of lugs attached to the spine, the lower set of lugs comprising first and second co-axial tubular lower lugs projecting perpendicular to the spine in the opposing first and second directions and wherein the first and second lower truss connectors are received in the first and second tubular lower lugs respectively; and the upper set of lugs attached to the spine, the upper set of lugs comprising first and second co-axial tubular upper lugs projecting perpendicular to the spine in the opposing first and second directions and wherein the first and second upper truss connectors are received in the first and second tubular lugs respectively.

2. The suspended scaffolding connector according to claim 1, wherein the lower and upper sets of truss connectors comprise male projections dimensioned to be received in tubular ends of the scaffolding truss members.

3. The suspended scaffolding connector according to claim 1, wherein the lower and upper sets of truss connectors are spaced apart by a distance of 780 millimetres along the spine.

4. The suspended scaffolding connector according to claim 1 further comprising a secondary set of truss connectors attached to the spine at a location between the lower and upper sets of truss connectors, the secondary set of truss connectors comprising first and second secondary co-axial truss connectors projecting perpendicular to the spine in opposing directions and co-planar with the lower and upper sets of truss connectors.

5. The suspended scaffolding connector according claim 4, wherein the first and second secondary truss connectors are removably coupled to the spine.

6. The suspended scaffolding connector according to claim 5, wherein the first and second secondary truss connectors are each attached to a spine connection bracket extending at right angles to the first and second secondary truss connectors, the spine connection brackets formed with grooves shaped and dimensioned to receive a portion of the spine.

7. The suspended scaffolding connector according to claim 4, wherein the secondary set of truss connectors is spaced apart along the spine from the upper set of truss connectors by a distance of 450 millimetres.

8. A suspended scaffolding system comprising:

a plurality of suspended scaffolding connectors according to claim 4 suspended from an overhead structure; and a plurality of scaffolding trusses, each of the plurality of scaffolding trusses comprising first and second connector components, the first connector component connected to one of the first and second secondary truss connectors of one or more adjacent suspended scaffolding connectors and the second connector component connected to one of: the first and second upper truss connectors and the first and second lower truss connectors of one or more adjacent suspended scaffolding connectors.

9. The suspended scaffolding system according to claim 8 comprising a plurality of scaffolding ledgers, each scaffolding ledger attached to and spanning between two opposing sets of upper truss connectors or two opposing sets of lower truss connectors in a direction substantially orthogonal to the directions of elongation of the upper and lower sets of truss connectors.

10. The suspended scaffolding system according to claim 8 comprising one or more sets of cross-braces, each set of cross-braces comprising a first brace and a second brace, the first brace and second brace aligned to cross one another as the first brace and the second brace extend between opposing scaffolding trusses.

11. The suspended scaffolding system according to claim 8 comprising a plurality of deck platform sections, each deck platform section attached to and spanning between two of the plurality of scaffolding trusses in a direction transverse to the plurality of scaffolding trusses.

12. The suspended scaffolding connector according to claim 1, wherein the lower and upper truss connectors are respectively detachable from the lower and upper sets of lugs.

13. The suspended scaffolding connector according to claim 1 further comprising reinforcing gussets attached to each of the lower and upper lugs and to the spine.

14. The suspended scaffolding connector according to claim 1, wherein the anchor connector is detachable from the spine.

15. The suspended scaffolding connector according to claim 14, the anchor connector further comprising:

a suspension rod receivable within a bore of the central spine, the suspension rod and central spine each defining at least one transversely extending aperture for receiving a fastener therethrough; and an anchor bracket attached at a top end of the suspension rod.

16. The suspended scaffolding connector according to claim 15, wherein the at least one aperture comprises a first aperture and a second aperture spaced apart from the first aperture and non-co-planar with the first aperture.

17. The suspended scaffolding connector according to claim 14, wherein the central spine defines a channel therethrough for receiving a suspension means when the anchor connector is detached.

18. The suspended scaffolding connector according to claim 1, the suspended scaffolding connector further comprising lower and upper ledger connectors attached to the central spine and adapted for connection to a scaffolding ledger or a brace member.

19. The suspended scaffolding connector according to claim 18, wherein the lower and upper ledger connectors are positioned between the lower and upper sets of truss connectors.

20. The suspended scaffolding structure according to claim 18, wherein the lower and upper ledger connectors each comprise at least one of a ring, loop, disc and rosette configured for removable attachment to the scaffolding ledger or brace member.

21. A suspended scaffolding system comprising:

a plurality of suspended scaffolding connectors according to claim 1 suspended from an overhead structure; and a plurality of scaffolding trusses, each of the plurality of scaffolding trusses extending between two of the suspended scaffolding connectors; each of the plurality of scaffolding trusses comprising connected hollow upper and lower members and having one of the first and second upper truss connectors of each of the two suspended scaffolding connectors received in opposed ends of the upper member and having one of the first and second lower truss connectors of each of the two suspended scaffolding connectors received in opposed ends of the lower member.

22. The suspended scaffolding system according to claim 21 comprising a plurality of scaffolding ledgers, each scaffolding ledger attached to and spanning between two of the suspended scaffolding connectors.

23. The suspended scaffolding system according to claim 21 comprising one or more sets of cross-braces, each set of cross-braces comprising a first brace and a second brace, the first brace and second brace arranged to cross one another.

24. The suspended scaffolding system according to claim 21 comprising a plurality of deck platform sections, each deck platform section supported by and spanning between two of the plurality of scaffolding trusses in a direction substantially transverse to the scaffolding trusses.

* * * * *